US006089419A

United States Patent [19]

Gross

[11] Patent Number: 6,089,419

[45] **Date of Patent: *Jul. 18, 2000**

[54] DISPENSING STRUCTURE WHICH HAS A LID WITH A PRESSURE-OPENABLE VALVE

[75] Inventor: Richard A. Gross, Oconomowoc, Wis.

[73] Assignee: AptarGroup, Inc., Crystal Lake, Ill.

[ * ] Notice: This patent is subject to a terminal disclaimer.

[21] Appl. No.: 09/414,177

[22] Filed: Oct. 7, 1999

Related U.S. Application Data

[63] Continuation of application No. 09/181,342, Oct. 28, 1998, Pat. No. 6,006,960.

[51] Int. Cl.[7] ..... B65D 5/72; B65D 47/00; B65D 25/40

[52] U.S. Cl. ..... 222/494; 222/545; 222/556; 220/256

[58] Field of Search ..... 222/494, 545, 222/556; 220/256

[56] References Cited

U.S. PATENT DOCUMENTS

| | | |
|---|---|---|
| 2,753,051 | 7/1956 | Tupper . |
| 4,717,050 | 1/1988 | Wright . |
| 4,728,006 | 3/1988 | Drobish et al. . |
| 4,747,498 | 5/1988 | Gach . |
| 4,749,108 | 6/1988 | Dornbusch et al. . |
| 4,773,570 | 9/1988 | Workum . |
| 4,832,219 | 5/1989 | Nycz . |
| 4,969,581 | 11/1990 | Seifert et al. . |
| 4,991,745 | 2/1991 | Brown . |
| 5,007,555 | 4/1991 | Beck . |
| 5,033,655 | 7/1991 | Brown . |
| 5,071,017 | 12/1991 | Stull . |
| 5,115,950 | 5/1992 | Rohr . |
| 5,139,182 | 8/1992 | Appla . |
| 5,165,564 | 11/1992 | Prout et al. . |
| 5,203,838 | 4/1993 | Schneider . |
| 5,213,236 | 5/1993 | Brown et al. . |
| 5,271,531 | 12/1993 | Rohr et al. . |
| 5,325,999 | 7/1994 | Gueret . |
| 5,339,995 | 8/1994 | Brown et al. . |
| 5,377,877 | 1/1995 | Brown et al. . |
| 5,390,805 | 2/1995 | Bilani et al. . |
| 5,409,144 | 4/1995 | Brown . |
| 5,439,143 | 8/1995 | Brown et al. . |
| 5,454,489 | 10/1995 | Vesborg . |
| 5,460,282 | 10/1995 | Giblin et al. . |
| 5,472,122 | 12/1995 | Appleby . |
| 5,531,363 | 7/1996 | Gross et al. . |
| 5,642,824 | 7/1997 | Hess, III et al. . |
| 5,676,289 | 10/1997 | Gross et al. . |
| 5,680,969 | 10/1997 | Gross . |
| 5,788,108 | 8/1998 | Rohr . |
| 6,006,960 | 12/1999 | Gross ..... 222/494 |

FOREIGN PATENT DOCUMENTS

| | | |
|---|---|---|
| 160336 | 11/1985 | European Pat. Off. . |

*Primary Examiner*—Kevin Shaver
*Assistant Examiner*—David Deal
*Attorney, Agent, or Firm*—Rockey, Milnamow & Katz, Ltd.

[57] ABSTRACT

A dispensing structure is provided for discharging the contents from the interior of a container. The structure includes a body for extending from the container. The body defines a dispensing opening and a sealing surface around the dispensing opening. A lid is provided for movement between open and closed positions. The lid has a frame defining a lid dispensing passage through the lid. The lid includes a flexible valve that is disposed within the lid frame across the lid dispensing passage. The flexible valve has self-sealing slits which open to permit flow therethrough in response to increased pressure on the side of the valve facing the container when the lid is closed.

14 Claims, 7 Drawing Sheets

DISPENSING STRUCTURE WHICH HAS A LID WITH A PRESSURE-OPENABLE VALVE

CROSS REFERENCE TO RELATED APPLICATION

This is a continuation of U.S. patent application Ser. No. 09/181,342, filed Oct. 28, 1998, now U.S. Pat. No. 6,006,960.

STATEMENT REGARDING FEDERALLY SPONSORED RESEARCH OR DEVELOPMENT

Not applicable.

REFERENCE TO A MICROFICHE APPENDIX

Not applicable.

TECHNICAL FIELD

This invention relates to a system for dispensing a product from a container. This invention is more particularly related to a system incorporating a dispensing valve which is especially suitable for use with a container from which a substance can be discharged from the container through the valve when the interior container pressure is increased.

BACKGROUND OF THE INVENTION

AND

TECHNICAL PROBLEMS POSED BY THE PRIOR ART

A variety of packages, including dispensing packages or containers, have been developed for personal care products such as shampoo, lotion, etc., as well as for other materials. Such containers typically have a neck defining an open upper end on which is mounted a dispensing closure.

One type of dispensing closure for these kinds of containers has a flexible, pressure-openable, self-sealing, slit-type dispensing valve mounted in the closure over the container opening. When the container is squeezed, the valve slits open, and the fluid contents of the container are discharged through the open slits of the valve. The valve automatically closes to shut off fluid flow therethrough upon removal of the increased pressure--even if the container is inverted so that the valve is subjected to the weight of the contents within the container.

Designs of closures using such valves are illustrated in the U.S. Pat. Nos. 5,271,531 and 5,033,655. Typically, the closure includes a body mounted on the container neck to hold the valve over the container opening.

A lid can be provided for covering the valve during shipping and when the container is otherwise not in use. See, for example, FIGS. 31–34 of U.S. Pat. No. 5,271,531. Such a lid can be designed to prevent leakage from the valve under certain conditions. The lid can also keep dust and dirt from the valve and/or can protect the valve from damage.

The inventor of the present invention has determined that it would be advantageous to provide an improved dispensing structure that has a lid and a flexible, slit valve and that can have multiple modes of operation on a container. It would be particularly beneficial to provide such a dispensing structure with the capability in a first operational mode for accommodating the removal of product from the container with a spoon or by pouring. It would be beneficial to provide a second mode of operation for accommodating the squirting of a stream of product through the valve.

It would also be desirable to provide such an improved dispensing structure for covering the product in the container while at the same time accommodating venting of gases through the valve. This would permit, for example, microwave heating of a food product in the container because steam or other gases driven off in the heating process could readily escape through the valve.

Such an improved dispensing structure should also accommodate designs which permit incorporation of the dispensing structure as a unitary part, or extension, of the container and which also accommodate designs that separately mount the dispensing structure on the container in a secure manner.

It would also be beneficial if such an improved dispensing structure could readily accommodate its manufacture from a variety of different materials.

Further, it would be desirable if such an improved dispensing structure could be provided with a design that would accommodate efficient, high-quality, large volume manufacturing techniques with a reduced product reject rate.

Preferably, the improved dispensing structure should also accommodate high-speed manufacturing techniques that produce products having consistent operating characteristics unit-to-unit with high reliability.

The present invention provides an improved dispensing structure which can accommodate designs having the above-discussed benefits and features.

SUMMARY OF THE INVENTION

According to one aspect of the present invention, a dispensing structure is provided for discharging the contents from the interior of a container. The dispensing structure includes a body for extending from the container. The body defines a dispensing opening for establishing communication between the exterior and interior of the container. The body has a sealing surface around the body dispensing opening.

A dispensing structure includes a lid having a frame defining a lid dispensing passage through the lid. The lid also includes a flexible valve that is disposed within the lid frame across the lid dispensing passage. The valve has self-sealing slits which open to permit flow therethrough in response to increased pressure on the side of the valve facing the container when the lid is closed. The lid accommodates movement between (1) a closed position over the body dispensing opening whereby the container contents can be dispensed through the dispensing opening and the valve, and (2) an open position away from the dispensing opening to accommodate pouring of the contents from the container through the dispensing opening without flowing through the valve. The lid, when in the closed position, is in sealing relationship with the body sealing surface.

In a preferred embodiment described in detail hereinafter, the body sealing surface is annular and defines at least a portion of the body dispensing opening. The lid has a sealing member for sealingly engaging the body sealing surface when the lid is in the closed position. In particular, the lid includes an inwardly extending, annular flange. The lid annular flange defines the sealing member for sealingly engaging the body sealing surface when the lid is in the closed position.

When the lid is closed, the container can be squeezed to dispense a flowable product out of the container through the valve. Also, when the lid is closed, the container can be heated, as in a microwave oven, and any gases generated during the heating can escape by venting through the valve.

If it is desired to remove product from the container with a spoon, the lid, with the valve held therein, can be moved to the open position. A spoon can then be inserted into the container. Alternatively, with the lid in the open position, the container can be inverted, and the product can be poured out of the container.

Numerous other advantages and features of the present invention will become readily apparent from the following detailed description of the invention, from the claims, and from the accompanying drawing.

BRIEF DESCRIPTION OF THE DRAWINGS

In the accompanying drawings that form part of the specification, and in which like numerals are employed to designate like parts throughout the same.

FIG. 6 shows the closure in the closed condition with a releasable label or cover placed on the top of the closed lid;

FIG. 12 shows the closure with an attached lid in an open position;

FIG. 16 shows the second embodiment of the dispensing structure in a closed condition.

DESCRIPTION OF THE PREFERRED EMBODIMENTS

Figure 1:
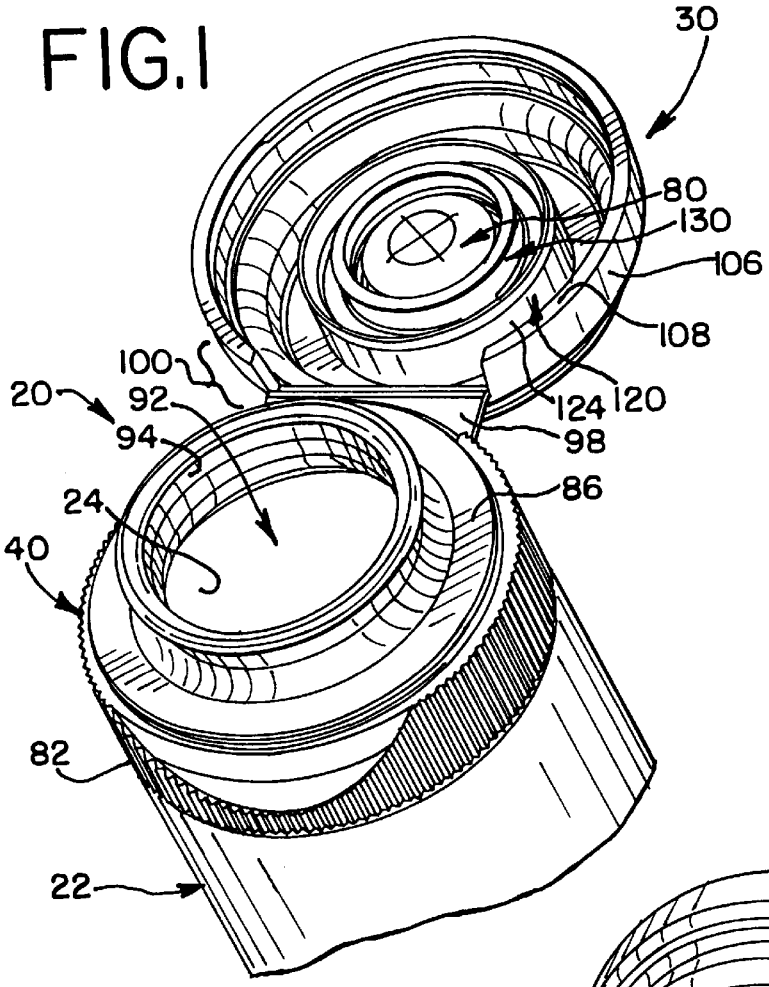
FIG. 1 is a fragmentary, perspective view of a first embodiment of the dispensing structure of the present invention which comprises a separate closure that is mounted on a container and that has an attached lid shown in an open position.

While this invention is susceptible of embodiment in many different forms, this specification and the accompanying drawings disclose only some specific forms as examples of the invention. The invention is not intended to be limited to the embodiments so described, however. The scope of the invention is pointed out in the appended claims.

For ease of description, the dispensing structure of this invention is described in various operating positions. It will be understood, however, that the dispensing structure of this invention may be manufactured, stored, transported, used, and sold in orientations other than the positions described.

One presently preferred embodiment of the dispensing structure of the present invention is illustrated in FIGS. 1–11 in the form of a dispensing closure designated generally in many of the figures by the reference number 20. The dispensing structure or closure 20 is provided as a separately manufactured unit for mounting to the top of a container 22. It will be appreciated, however, that it is contemplated that in some applications it may be desirable for the dispensing structure 20 to be formed as a unitary part, or extension, of the container 22.

The container 22 typically has a conventional mouth 24 (FIG. 1) which provides access to the container interior and product contained therein. The product may be, for example, a liquid comestible product. The product could also be any other solid, liquid, or gaseous material, including, but not limited to, a food product, a personal care product, an industrial or household cleaning product, a paint product, a wall patch product, or other chemical compositions (e.g., for use in activities involving manufacturing, commercial or household maintenance, construction, remodeling, and agriculture), etc.

The container 22 may typically have a neck or other suitable structure defining the container mouth 24. The neck may have (but need not have) a circular cross-sectional configuration, and the body of the container 22 may have another cross-sectional configuration, such as an oval cross-sectional shape, for example. The container 22 may, on the other hand, have a substantially constant shape along its entire length or height without any neck portion of reduced size or different cross-section.

The container 22 may typically be a squeezable container having a flexible wall or walls which can be grasped by the user and compressed to increase the internal pressure within the container 22 so as to squeeze the product out of the container 22 through the closure 20 when the closure 20 is open. Such a container wall typically has sufficient, inherent resiliency so that when the squeezing forces are removed, the container wall returns to its normal, unstressed shape. Such a structure is preferred in many applications, but may not be necessary or preferred in other applications. Indeed, the container 22 may be substantially rigid. A piston could be provided in such a rigid container to aid in dispensing a product, especially a relatively viscous product.

The dispensing structure or closure 20 comprises a base or body 40, and a lid 30 which includes a frame (described in detail hereinafter) and a flexible, pressure-openable, slit-type valve 80 mounted within the frame.

Figure 2:
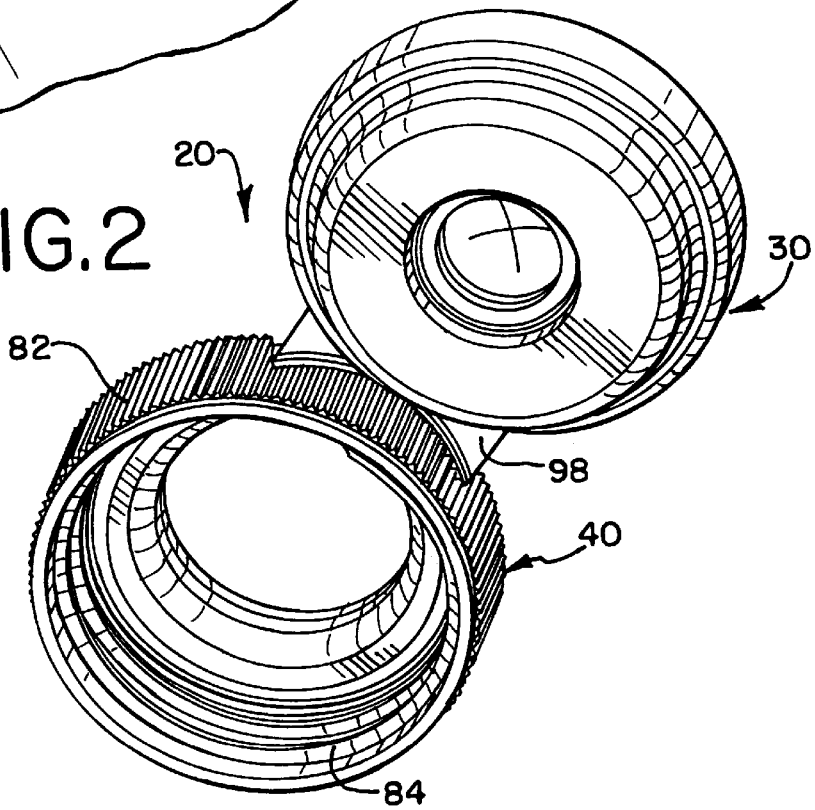
FIG. 2 is a perspective view of the bottom of the first embodiment of the closure in an open position shown removed from the container.
Figure 3:
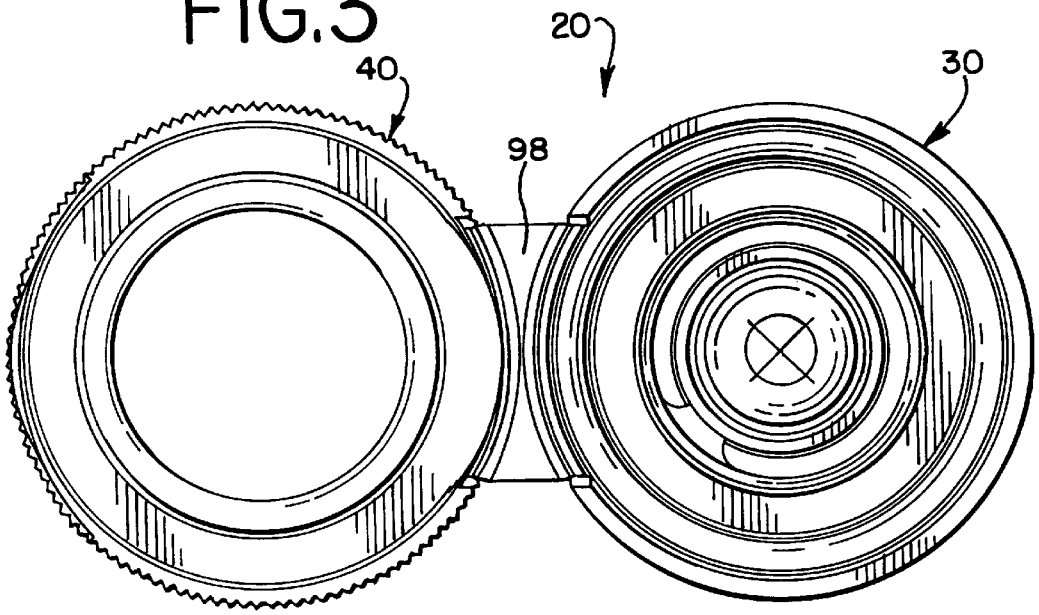
FIG. 3 is a top plan view of the first embodiment of the open closure.
Figure 4:
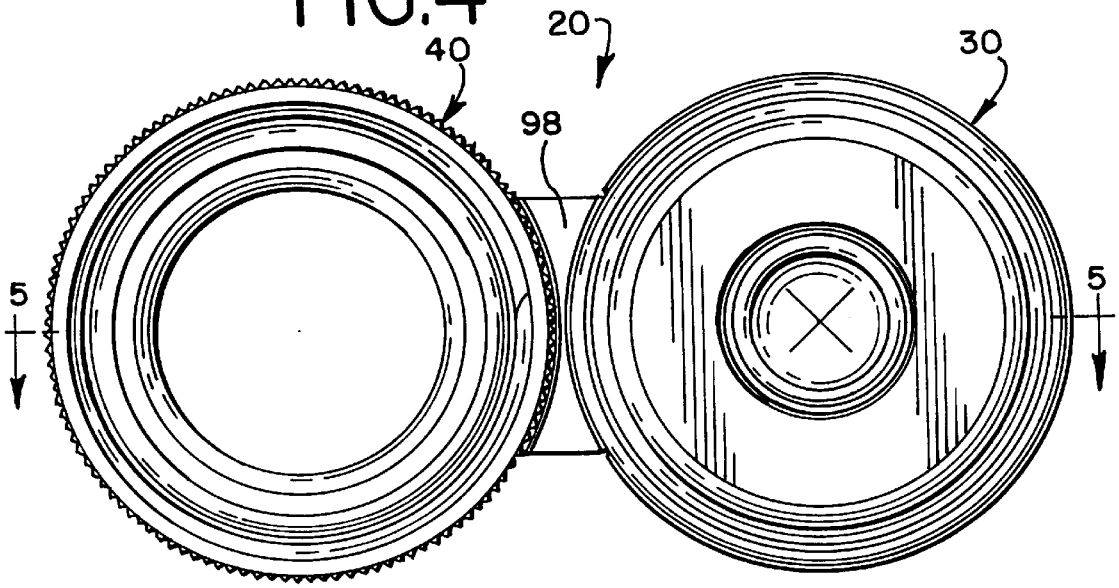
FIG. 4 is a bottom plan view of the first embodiment of the open closure.
Figure 5:
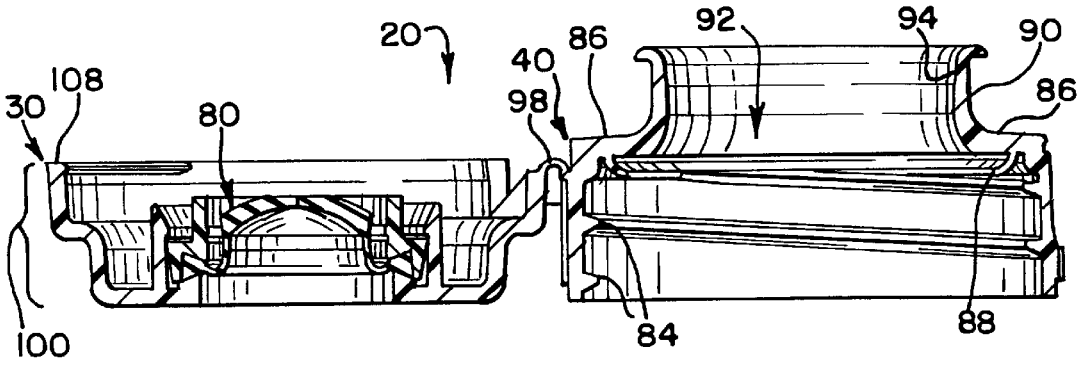
FIG. 5 is a cross-sectional view taken generally along the plane 5—5 in FIG. 4.

The closure body 40 defines a skirt 82 which has a conventional thread 84 as shown in FIG. 2 for engaging a thread on the container neck (not shown in FIG. 2) to secure the closure body 40 to the neck of the container 22.

The closure body 40 and container 22 could also be releasably connected with a snap-fit bead and groove, or by other means. Alternatively, the closure body 40 may be permanently attached to the container 22 by means of induction melting, ultrasonic melting, gluing, or the like, depending upon the materials employed for the container and closure. Further, the closure 20 could, in some applications, be formed as a unitary part, or extension, of the container 22.

Figure 6:
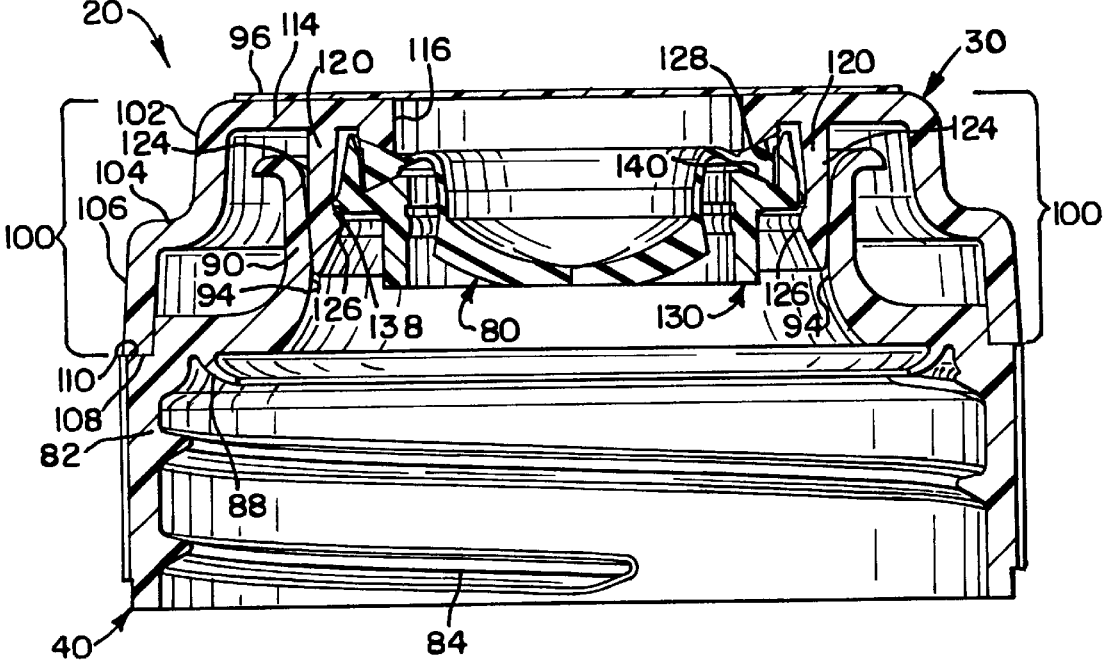
FIG. 6 is a greatly enlarged view similar to FIG. 5, but in FIG. 6 the cross-sectional view plane is taken perpendicular to the plane of FIG. 5.

At the top of the closure skirt 82, the closure body 40 defines a radially inwardly extending, annular shoulder 86 (FIG. 1). Preferably, as can be seen in FIG. 6, an annular, flexible "crab's claw" shaped seal 88 projects from the lower portion of the closure body shoulder 86 adjacent the upper end of the container neck so as to provide a leak-tight seal between the closure body 40 and the container neck. Of course, other types of closure body/container seals may be employed.

Projecting outwardly (i.e., upwardly in FIGS. 5 and 6) from the closure body shoulder 86 is an annular housing portion or spout 90 having an open distal end which can be closed by the lid 30. The annular housing portion 90 defines an internal dispensing opening 92 (FIG. 5) for establishing communication between the exterior and interior of the container. At least part of the opening 92 is defined by a generally annular sealing surface 94 (FIG. 5) on the inside of the annular housing portion 90.

The lid 30, when closed, functions as a cover when product is not being dispensed from the container. Further, a label or other releasable seal member or cover, such as label 96 (FIG. 6), can be secured over the top of the closed lid 30 so that the closed lid 30 can also function as a substantially leak-tight lid to prevent air ingress and/or discharge of the product from the container when the container is subjected to intentional or inadvertent impact that may temporarily increase the pressure within the container. The lid 30, with such a releasable label 96 secured thereto, will prevent discharge from the container during shipping of the container, during warehousing, and while the container is on display in a store, or while a container is initially being stored by a user.

The lid 30 is preferably hingedly connected to the closure body 40 with a snap-action hinge 98 (FIG. 1). Such a hinge is disclosed in the U.S. Pat. No. 5,642,824, the disclosure of which is incorporated herein by reference thereto. In an alternate embodiment, the lid need not be connected with a snapaction hinge. A floppy hinge may be used instead. Further, in another embodiment (not illustrated), no hinge at all need be employed. The lid could be completely separate, and completely removable, from the closure body.

In the first embodiment of the closure illustrated in FIGS. 1–11, the lid 30 includes a sidewall or skirt 100 (FIG. 5) from which the hinge 98 extends to the body 40. As shown in FIG. 6, the lid skirt 100 has an upper part 102, an intermediate shoulder 104, and a lower part 106. The lower part 106 has a seating surface 108 (FIGS. 1 and 6). When the lid 30 is closed, the seating surface 108 engages an annular shoulder 110 defined on the closure body 40 at the top of the closure body skirt 82.

The lid 30 includes an annular end wall 114 defining a central dispensing passage 116 (FIG. 6). When the lid 30 is closed, the dispensing passage 116 is generally in alignment with the closure body dispensing opening 92 that is defined at least in part by the sealing surface 94.

Figure 7:
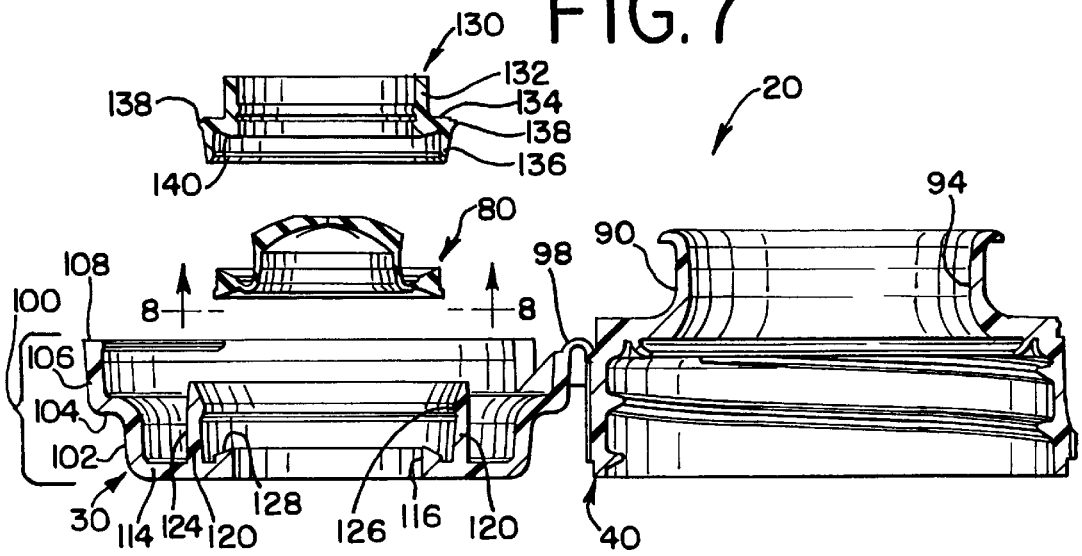
FIG. 7 is a view similar to FIG. 5, but FIG. 7 shows the lid components in an exploded view.

In the preferred embodiment, the lid 30 has a sealing ring or sealing member 120 which is separate from the valve 80. The lid sealing member 120 projects from the lid end wall 114 (FIG. 7). The sealing member 120 is an annular sealing flange defining a generally cylindrical exterior surface 124 for sealingly engaging the closure body sealing surface 94 when the lid 30 is closed (FIG. 6). The diameter of the lid sealing flange exterior surface 124 is slightly larger than the diameter of the smallest opening defined by the body sealing surface 94. This creates an interference fit and consequently establishes an liquid-tight seal. If desired, the closure body sealing surface 94 could include an annular seal bead (not illustrated) to enhance the sealing action.

As shown in FIG. 7, the lid seal ring 120 has an annular bead 126 extending radially inwardly. Also, the lid end wall 114 includes an angled clamping surface or seating surface 128 which faces the valve 80.

The valve 80 is adapted to be held against the clamping or seating surface 128 by a retaining ring 130 (FIG. 7). The retaining ring 130 includes a sleeve 132, an annular shoulder 134, and an annular collar 136. The collar 136 merges with the outer periphery of the shoulder 134 to define a retention lip 138. As shown in FIG. 6, when the retaining ring 130 is inserted into the lid 30, the retaining ring lip 138 is received adjacent the lid seal ring bead 126 in a snap-fit engagement. The retaining ring 130 includes an angled clamping surface 140 for engaging a portion of the valve 80 and holding the valve 80 tight against the lid clamping surface or seating surface 128 shown in FIG. 6.

The valve 80 is designed to be effectively clamped in position within the closure lid 30 by the retaining ring 130 (FIGS. 6 and 7). Together, the lid skirt 100 and end wall 114 may be characterized as a "frame" for defining the dispensing passage 92 and holding the valve 80 clamped in place by the retaining ring 130. In some alternate designs (not illustrated), the lid skirt 100 and separate retaining ring 130 could be eliminated, and the remaining portion of the lid could be configured as necessary to function as a frame for defining the dispensing passage 92 and holding the valve 80.

In the preferred form of the valve 80 illustrated, the valve 80 is of a known design employing a flexible, resilient material, which can open to dispense fluid. The valve 80 may be fabricated from thermosetting elastomeric materials such as silicone, natural rubber, and the like. It is also contemplated that the valve 80 may be fabricated from thermoplastic elastomers based upon materials such as thermoplastic propylene, ethylene, urethane, and styrene, including their halogenated counterparts.

A valve which is similar to, and functionally analogous to, valve 80 is disclosed in the U.S. Pat. No. 5,439,143. However, the valve 80 has a peripheral flange structure (described in detail hereinafter) which differs from the flange structure of the valve shown in the U.S. Pat. No. 5,439,143. The description of the valve disclosed in the U.S. Pat. No. 5,439,143 is incorporated herein by reference to the extent pertinent and to the extent not inconsistent herewith.

Figure 9:
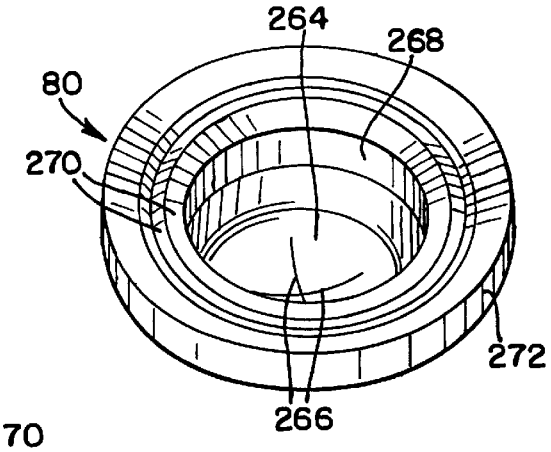
FIG. 9 is a perspective view of the valve.
Figure 8:
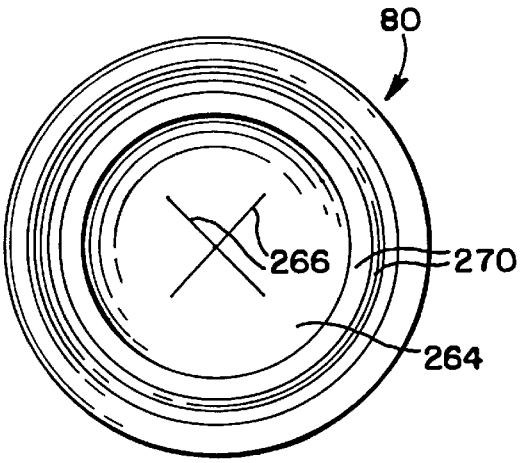
FIG. 8 is a greatly enlarged plan view of the lid valve taken generally along the plane 8—8 in FIG. 7.
Figure 10:
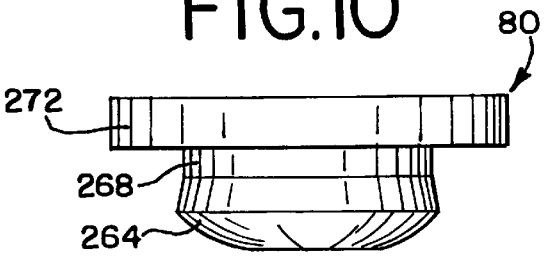
FIG. 10 is a side elevational view of the valve.

As illustrated in FIGS. 8–10, the valve 80 includes a flexible, central portion, wall, or face 264 which has an unactuated, concave configuration (when viewed from the exterior) and which defines two, mutually perpendicular, intersecting dispensing slits 266 of equal length. The intersecting slits 266 define four, generally sector-shaped, flaps or petals in the concave, central wall 264. The flaps open outwardly from the intersection point of the slits 266, in response to increasing container pressure of sufficient magnitude, in the well-known manner described in the U.S. Pat. No. 5,439,143.

The valve 80 includes a skirt 268 (FIGS. 9 and 10) which extends from the valve central wall or face 264. At the outer end of the skirt 268 there is a thin, annular flange 270 which extends peripherally from the skirt 268 in an angled orientation. The thin flange 270 terminates in an enlarged, much thicker, peripheral flange 272 which has a generally dovetail shaped transverse cross section (as viewed in FIG. 6).

To accommodate the seating of the valve 80 in the closure lid 30, the clamping or seating surface 128 of the closure lid 30 has a frustoconical configuration and has the same angle as the angle of the valve flange dovetail configuration. One side of the valve flange 272 is disposed against the closure lid seating surface 128.

The other surface of the valve flange 272 is clamped by the retaining ring 130. As illustrated in FIG. 6, the retaining ring annular clamping surface 140 is angled or has a frustoconical configuration. When the retaining ring 130 is mounted in the lid 30, the spacing between the clamping surface 140 of the retaining ring 130 and the closure lid valve seating surface 128 increases with increasing radial distance from the center of the valve 80 as can be seen in FIG. 6. Such a configuration defines an annular cavity with a transverse cross section having a dovetail shape which generally conforms to the dovetail shape of the valve flange 272.

This arrangement securely clamps and holds the valve 80 without requiring special internal support structures or bearing members adjacent the interior surface of the valve cylindrical skirt 268. This permits the region adjacent the interior surface of the valve cylindrical skirt 268 to be substantially open, free, and clear so as to accommodate movement of the valve skirt 268 as described hereinafter.

If desired, the valve 80 could be retained in the closure lid 30 without the retaining ring 130. For example, the valve 80 could be bonded to the closure lid 30 with adhesive or could be directly molded onto the closure lid 30 so as to create a weld defined by interface solidification of melted portions of the materials.

The valve 80 could be molded with the slits 266. Alternatively, the valve slits 266 could be subsequently cut into the wall or face 264 of the valve 80 by suitable conventional techniques.

When the valve 80 is properly mounted within the closure lid 30 as illustrated in FIG. 6, the central wall or face 264 of the valve 80 lies recessed within the closure lid 30. However, when the container 22 (FIG. 1) is squeezed to dispense the contents through the valve 80, then the valve central wall or face 264 is forced outwardly from its recessed position toward the end of the lid 30.

In some applications, it may be desirable to provide the releasable label or cover 96 on the lid 30 over the valve 80. In order to use the closure 20 to dispense product or other fluid through the valve 80, such a label or cover 96 must first be removed by the user.

Figure 11:
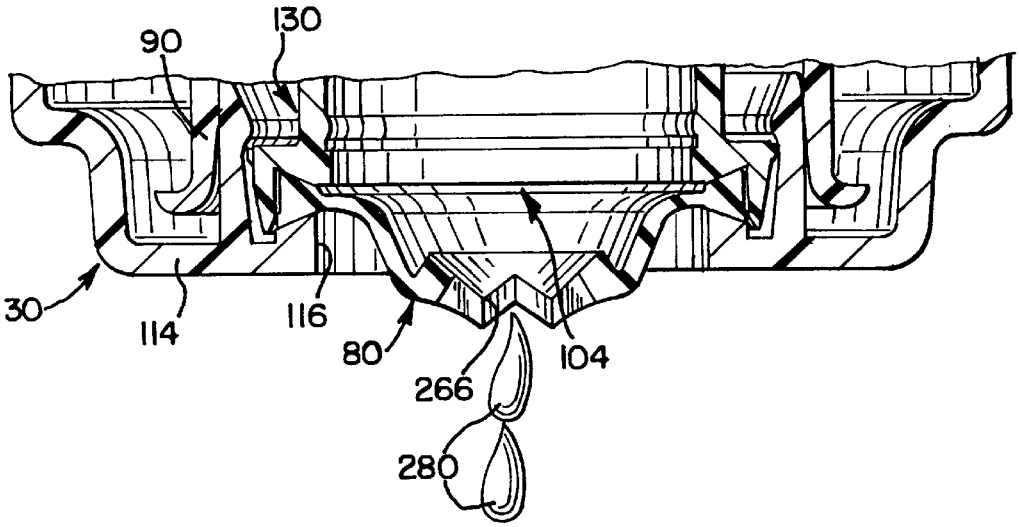
FIG. 11 is a greatly enlarged, fragmentary view similar to FIG. 6, but FIG. 11 shows the release cover or label removed from the top of the lid and shows the closure inverted in a dispensing mode.
Figure 12:
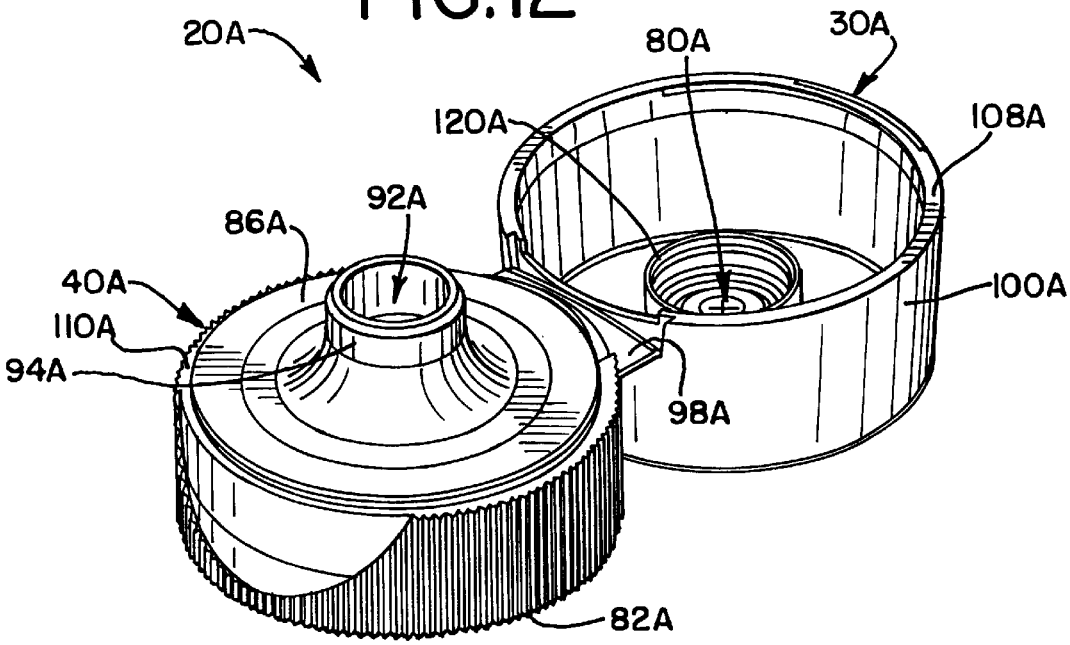
FIG. 12 is a perspective view similar to FIG. 1, but FIG. 12 shows a second embodiment of the dispensing structure of the present invention which comprises a separate closure adapted to be mounted on a container (not illustrated)
Figure 13:
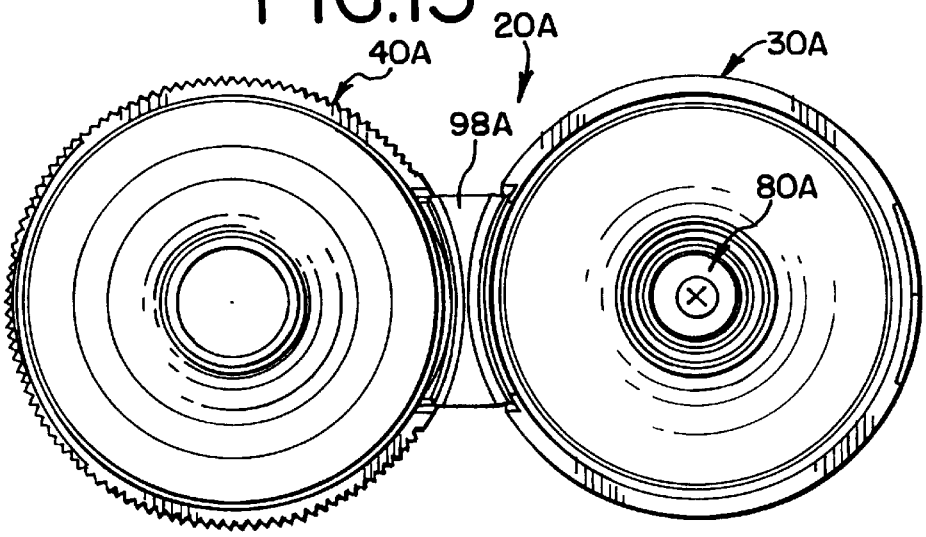
FIG. 13 is a top plan view of the second embodiment of the dispensing structure shown in FIG. 12.

In use, the container 22 is then typically inverted and squeezed to increase the pressure within the container 22 above the ambient exterior atmospheric pressure. This forces the product within the container toward the valve 80 and forces the valve 80 from the recessed or retracted position (illustrated in FIG. 6) toward the outwardly extending position (FIG. 11). The outward displacement of the central face 264 of the valve 80 is accommodated by the relatively, thin, flexible, skirt 268. The skirt 268 moves from an inwardly projecting, rest position to an outwardly displaced, pressurized position, and this occurs by the skirt 268 "rolling" along itself outwardly toward the outside of the lid 30 (toward the position shown in FIG. 11). However, the valve 80 does not open (i.e., the slits 266 do not open) until the valve central face 264 has moved substantially all the way to a fully extended position beyond the dispensing passage 116. Indeed, as the valve central wall 264 begins to move outwardly, the valve central wall 264 is initially subjected to radially inwardly directed compression forces which tend to further resist opening of the slits 266. Also, the valve central wall 264 generally retains its inwardly concave configuration as it moves outwardly and even after it reaches the fully extended position. However, when the internal pressure becomes sufficiently high after the valve central wall 264 has moved outwardly to the fully extended position, then the slits 266 of the valve 80 begin to open to dispense product (FIG. 11). The product is then expelled or discharged through the open slits 266. For illustrative purposes, FIG. 11 shows drops 280 of a liquid product being discharged.

When the closure 20 is manufactured and initially assembled on the container 22, the closure 20 is typically initially arranged in the closed condition (FIG. 6). This is also the condition in which the container 22 can be conveniently carried in a user's suitcase while the user is travelling.

It will be appreciated that the product can be dispensed through the valve 80 when the lid 30 is in the closed orientation as shown in FIG. 11. However, in some applications, it may be desirable to also permit vapor or other gases to be vented through the valve 80 when heating the container with the lid 30 closed (and the label or cover 96 is removed or never installed in the first place). In such applications, it may be preferable to also provide a protective baffle spaced outwardly of the dispensing passage, and such a feature is described in more detail hereinafter with reference to a second embodiment of the present invention illustrated in FIGS. 12–17.

Whether or not a baffle is employed, the container may be placed in a microwave oven, and the product within the container can be heated with the microwave energy. As gas or vapor is generated by the heating process, pressure will increase within the container. Eventually, the pressure becomes sufficiently high that the valve 80 is forced to the open configuration to permit the escape or venting of the vapor or gas. The use of the valve 80 with the small slits permits venting of the vapor or gas while still providing a sufficient cover over the product within the container so as to prevent significant splashing of the liquid product out of the container if the product boils or spurts within the container. Subsequently, after the completion of microwave heating, the product can be dispensed from the container through the valve 80 in the manner previously described with reference to FIG. 11.

The use of the closure 20 with the valve 80 for venting hot gases is advantageous compared with conventional microwaveable packages which require a portion of the package to first be opened by the user in order to establish a vent passage. The closure of the present invention is not only more convenient, but is also safer, especially in the hands of children.

It will also be appreciated that the closure 20 of the present invention may be used to permit the venting of gases that build up from a product within the container even when the container is not subjected to microwave energy. For example, over a period time, some products can undergo a chemical reaction which may generate gases within the container and/or gas pressure may build up within a container owing to high ambient temperatures or reduction in ambient pressures (e.g., airline transport). The valve 80 in the closure of the present invention will permit such gases to vent to ambient atmosphere (if the label or cover 96 is removed (or not installed in the first place)). This can prevent bulging of the container.

It will also be appreciated that the lid 30 can be moved to the fully opened position (FIG. 1) to permit access to the container interior. This provides another mode of operation. Specifically, the product within the container can then be poured out of the container through the closure body dispensing opening 92. Alternatively, a spoon, or other instrumentality, can be inserted into the container 22 through the dispensing opening for removing some of the product.

In some applications, it may be desirable to provide a foil membrane or a liner (not illustrated) across the bottom surface of the closure body shoulder 86 to occlude the body dispensing opening 92. The liner could alternatively be sealed to the container over the top of the container opening. In either case, the liner would first have to be broken away to provide communication with the container interior.

A second embodiment of the dispensing structure of the present invention is illustrated in FIGS. 12–17. The second embodiment of the dispensing structure has the form of a separate, removable dispensing closure 20A. The dispensing structure or closure 20A includes a lid 30A, a base or body 40A, and a flexible, pressure-openable, slit-type valve 80A.

Figure 15:
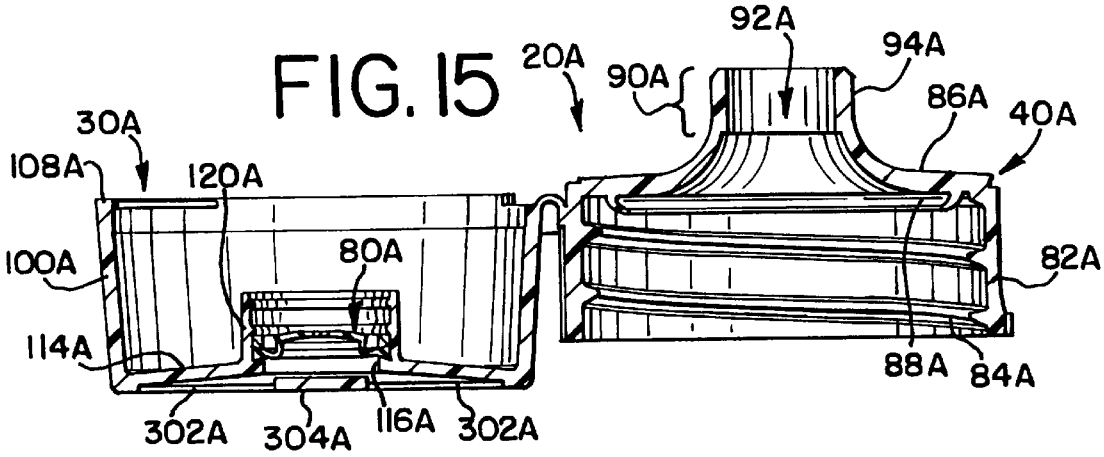
FIG. 15 is a cross-sectional view taken generally along the plane 15—15 in FIG. 14.

The closure body 40A defines a skirt 82A which has a conventional thread 84A as shown in FIG. 15 for engaging a thread on the container neck (not shown in FIG. 15) to secure the closure body 40A to the neck of the container.

The closure body 40A and container could also be releasably connected with a snap-fit bead and groove, or by other means. Alternatively, the closure body 40A may be permanently attached to the container by means of induction melting, ultrasonic melting, gluing, or the like, depending upon the materials employed for the container and closure. Further, the closure could, in some applications, be formed as a unitary part, or extension, of the container.

At the top of the closure skirt 82A, the closure body 40A defines a radially inwardly extending, annular shoulder 86A (FIGS. 1 and 15). Preferably, as can be seen in FIG. 15, an annular, flexible "crab's claw" shaped seal 88A projects from the lower portion of the closure body shoulder 86A adjacent the upper end of the container neck so as to provide a leak-tight seal between the closure body 40A and the container neck. Of course, other types of closure body/container seals may be employed.

Projecting outwardly (i.e., upwardly in FIGS. 15 and 16) from the closure body shoulder 86A is an annular housing portion, wall, or spout 90A having an open distal end which can be closed by the lid 30A. The annular wall, spout, or housing portion 90A defines an internal dispensing opening 92A (FIG. 15) for establishing communication between the exterior and interior of the container. At least part of the exterior of the annular wall or spout 90A defines a body sealing surface 94A (FIGS. 15 and 16).

The lid 30A, when closed, functions as a cover when product is not being dispensed from the container. The lid 30A is preferably hingedly connected to the closure body 40A with a snap-action hinge 98A (FIG. 12) which is identical with the hinge 98 described above with reference to the first embodiment of the dispensing structure illustrated in FIGS. 1–11. Alternatively, the lid 30A could be completely separate, and completely removable, from the closure body 40A.

Figure 14:
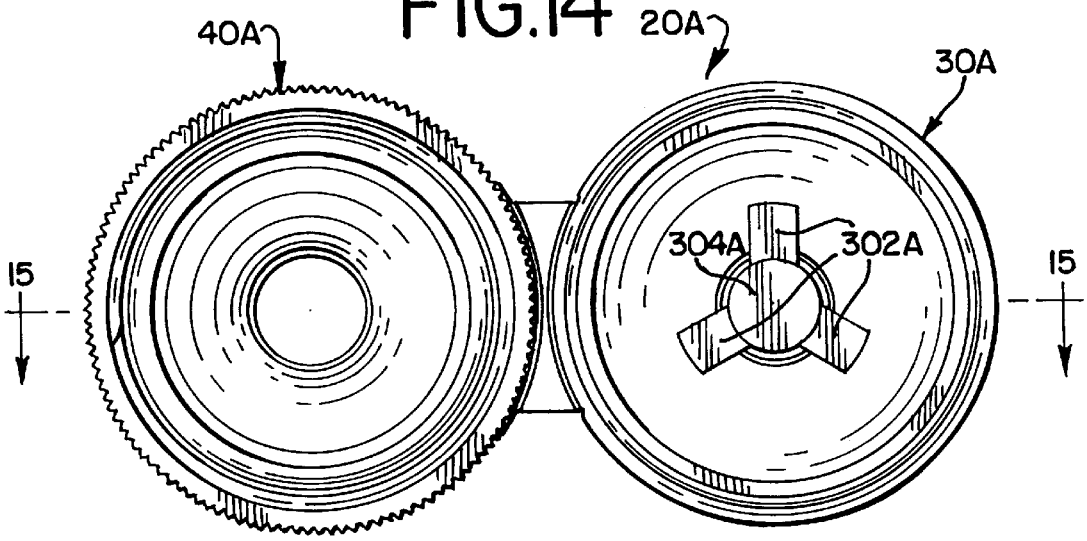
FIG. 14 is a bottom plan view of the second embodiment of the dispensing structure shown in FIG. 12.
Figure 16:
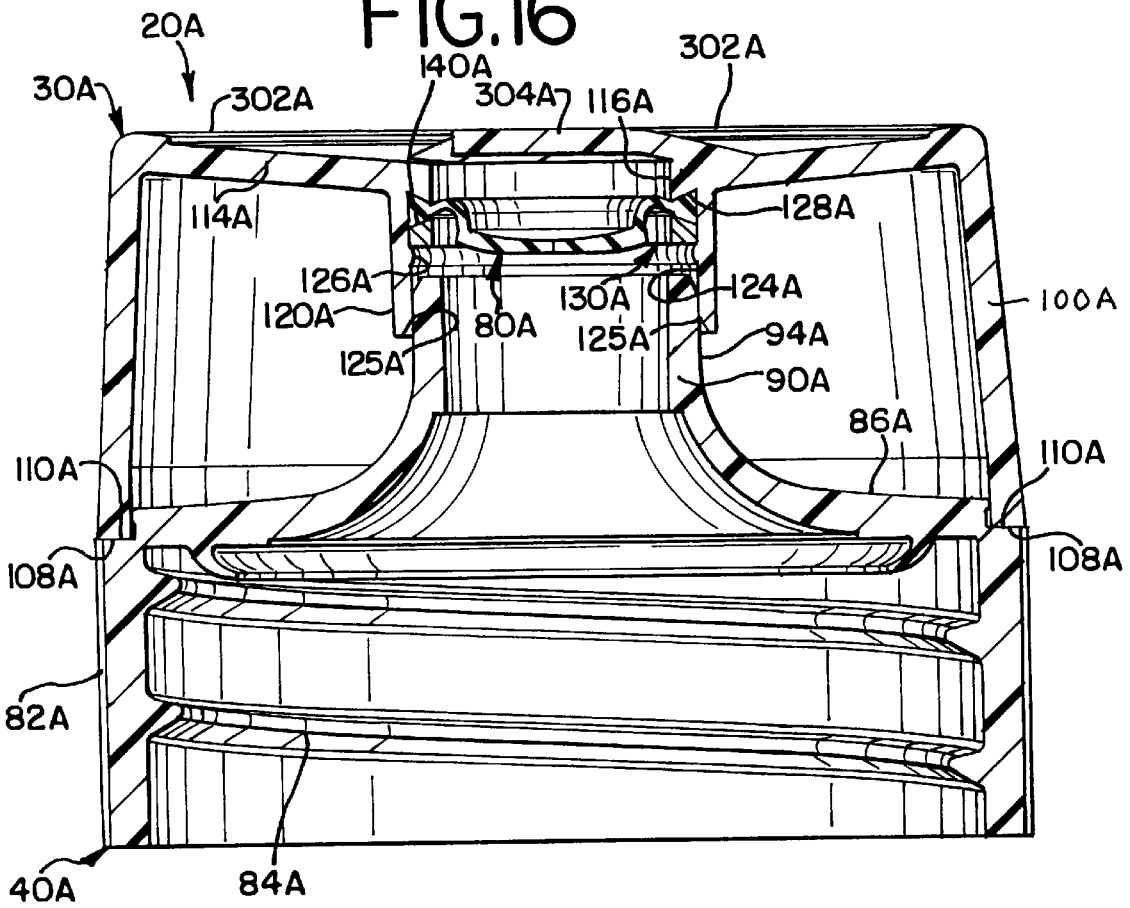
FIG. 16 is a greatly enlarged view similar to FIG. 15, but in FIG. 16 the cross-sectional view plane is taken generally perpendicular to the view plane of FIG. 15.

In the second embodiment of the closure 20A illustrated in FIGS. 12–17, the lid 30A includes a sidewall or skirt 100A (FIGS. 12 and 15) from which the hinge 98A extends to the body 40A. As shown in FIGS. 14 and 16, the lid skirt 100A has a seating surface 108A. When the lid 30A is closed (FIG. 16), the seating surface 108A engages an annular shoulder 110A defined on the closure body 40A at the top of the closure body skirt 82A.

The lid 30A includes an annular end wall 114A defining a central dispensing passage 116A (FIG. 16). When the lid 30A is closed, the dispensing passage 116A is generally in alignment with the closure body dispensing opening 92A that is defined at least in part by the annular wall or spout 90A.

Figure 17:
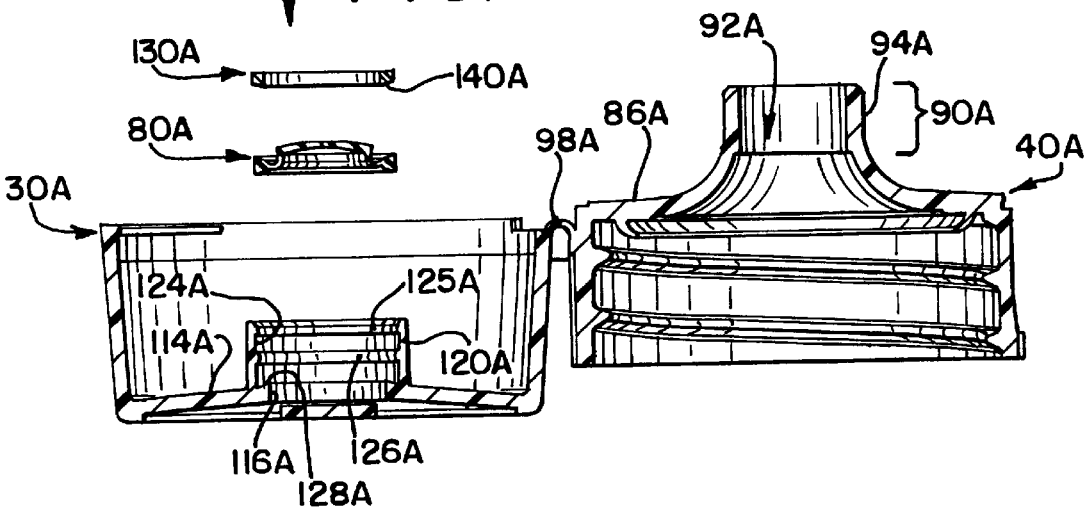
FIG. 17 is a view similar to FIG. 15, but FIG. 17 shows the lid components in an exploded view.

The lid 30A has a sealing ring or sealing member 120A projecting from the lid end wall 114A (FIGS. 16 and 17). The sealing member 120A is an annular sealing flange defining a generally cylindrical interior surface 124A for sealingly engaging the closure body sealing surface 94A when the lid 30A is closed (FIG. 16). Preferably, the lid sealing surface 124A includes an annular seal bead 125A to enhance the sealing action. The diameter of the bead 125A is slightly less than the diameter of the spout sealing surface 94A. This creates an interference fit and consequently establishes an liquid-tight seal.

As shown in FIG. 16, the lid sealing ring 120A has an annular bead 126A extending radially inwardly. Also, the lid end wall 114A includes an angled, frustoconical, clamping surface or seating surface 128A which faces the valve 80A.

The valve 80A is adapted to be held against the clamping or seating surface 128A by a retaining ring 130A (FIGS. 16 and 17). The valve 80A has the same structure as the valve 80 described above for the first embodiment of the closure 20 illustrated in FIGS. 12–17. As shown in FIG. 16, when the retaining ring 130A is inserted into the lid 30A, a peripheral edge of the retaining ring is received adjacent the lid seal ring bead 126A to hold the ring 130A in a snap-fit engagement. The retaining ring 130A includes an angled, frustoconical, clamping surface 140A for engaging one side of the valve flange to clamp the valve 80A tight against the lid seating surface 128A.

The second embodiment of the closure 20A includes a unique structure on the outside of the lid 30A. In particular, supported on the periphery of the lid end wall 114A is a non-removable, protective disk, cage, or baffle comprising three support arms 302A (FIG. 14) and a central deflection member or baffle member 304A. The member 304A has a generally disk-like configuration as can be seen in FIG. 14. The member 304A is disposed generally in alignment with the dispensing passage 116A in the lid end wall 114A. Thus, the member 304A is also in alignment with the valve 80A.

This baffle structure over the dispensing passage 116A is most beneficial in a closure 20A wherein the purpose of the valve 80A is only to provide a vent for the package. The central baffle member 304A will prevent hot gases or vapors from being discharged directly outwardly as a jet or stream for a significant distance beyond the lid end wall 114A. The central baffle member 304A will cause the venting vapor or steam to be dissipated laterally around the top exterior portion of the lid end wall 114A.

With such a venting system, it is preferable to provide a relatively strong valve 80A. Because the valve 80A would be used only for venting and not for discharging product, the baffle 304A would not be impacted by product. Rather, when it is desired to dispense the product, the lid 30A is moved to the fully opened position. Then the container can be inverted to point the dispensing closure body spout 90A generally downwardly. The product can then be poured out of the container through the spout 90A. Alternatively, if the spout

90A is relatively large, a spoon or other instrument can be inserted through the spout for lifting out desired quantities of the product.

It may also be desirable in many applications to provide an interior foil, membrane, or liner (not illustrated) across the top of the mouth of the container or secured to the inside surface of the closure body shoulder 86A so as to occlude the dispensing opening 92A. This would insure leak-tightness and freshness until the user removes, or otherwise destroys the integrity of, such a foil, membrane, or liner.

It will be readily observed from the foregoing detailed description of the invention and from the illustrations thereof that numerous other variations and modifications may be effected without departing from the true spirit and scope of the novel concepts or principles of this invention.

What is claimed is:

1. A dispensing structure for discharging the contents from the interior of a container, said dispensing structure comprising:

a body for extending from said container, said body defining a dispensing opening for establishing communication between the exterior and interior of said container, and said body having a sealing surface around said body dispensing opening; and a lid having a frame defining a lid dispensing passage through said lid, said lid including a flexible valve that is disposed within said lid frame across said lid dispensing passage and that has self-sealing slits which open to permit flow therethrough in response to increased pressure on the side of said valve facing said container when said lid is closed, said lid accommodating movement between (1) a closed position over said body dispensing opening whereby the container contents can be dispensed through said dispensing opening and said valve, and (2) an open position away from said dispensing opening to accommodate pouring of the contents from the container through said dispensing opening without flowing through said valve, said lid when in said closed position being in sealing relationship with said body sealing surface.

2. The dispensing structure in accordance with claim 1 in which said body is formed separately from said container; and said body has a skirt with an internal thread for threadingly engaging an external thread on said container to permit said body to be removably mounted to said container.

3. The dispensing structure in accordance with claim 1 in which said body is a unitary part of said container.

4. The dispensing structure in accordance with claim 1 in which said lid is hingedly connected to said body.

5. The dispensing structure in accordance with claim 1 in which said valve has a peripheral flange with a dove tail cross section; and said lid frame has an upper, frustoconical seating surface for engaging one side of said valve flange.

6. The dispensing structure in accordance with claim 5 in which said lid includes a retaining ring that is separate from said frame, that is in snap-fit engagement with said frame, and that defines a lower, frustoconical seating surface for engaging another side of said valve flange to clamp said valve flange between said upper and lower frustoconical seating surfaces.

7. The dispensing structure in accordance with claim 1 in which said body sealing surface is annular and defines at least a portion of said body dispensing opening; and said lid having a sealing member which is separate from said valve and which is an inwardly extending, annular sealing flange defining a generally cylindrical exterior surface for sealingly engaging said body sealing surface when said lid is closed.

8. The dispensing structure in accordance with claim 1 in which said body has a generally annular wall that defines said body dispensing opening and that has an exterior surface defining said body sealing surface; and said lid has a sealing member which is an inwardly extending, annular sealing flange that is separate from said valve and that has a generally cylindrical interior surface for sealingly engaging said body sealing surface when said lid is closed.

9. The dispensing structure in accordance with claims 7 or 8 in which one of said body sealing surface and said lid sealing flange includes a seal bead.

10. The dispensing structure in accordance with claim 1 in which said lid includes a releasable cover adhesively secured to said lid frame over said lid dispensing passage.

11. The dispensing structure in accordance with claim 1 in which said body includes a liner below, and occluding, said dispensing opening.

12. The dispensing structure in accordance with claim 1 in which said lid includes a protective cage extending from said lid frame across said lid dispensing passage and over said valve.

13. The dispensing structure in accordance with claim 1 in which said lid has a sealing member which is a unitary extension of said lid frame.

14. A dispensing structure in accordance with claim 1 in which said body sealing surface is annular and defines at least a portion of said body dispensing opening;

said lid includes an inwardly extending, annular flange;

said valve defines a peripheral flange; and one of said valve flange and said lid annular flange defines a sealing member for sealingly engaging said body sealing surface when said lid is in said closed position.

* * * * *